US005887996A

United States Patent [19]

Castelli et al.

[11] Patent Number: 5,887,996

[45] Date of Patent: Mar. 30, 1999

[54] APPARATUS AND METHOD FOR SHEET REGISTRATION USING A SINGLE SENSOR

[75] Inventors: Vittorio R. Castelli, Yorktown Heights, N.Y.; Osman T. Polatkan, North Haledon, N.J.

[73] Assignee: Xerox Corporation, Stamford, Conn.

[21] Appl. No.: 4,293

[22] Filed: Jan. 8, 1998

[51] Int. Cl.[6] ..... B41J 11/42

[52] U.S. Cl. ..... 400/579; 271/227; 271/250; 399/395

[58] Field of Search ..... 271/227, 226, 271/228, 250; 400/579; 101/232; 399/395

[56] References Cited

U.S. PATENT DOCUMENTS

| | | | |
|---|---|---|---|
| 4,438,917 | 3/1984 | Janssen et al. | 271/227 |
| 4,511,242 | 4/1985 | Ashbee et al. | 355/14 |
| 4,519,700 | 5/1985 | Barker et al. | 355/3 SH |
| 4,641,272 | 2/1987 | Sasaki et al. | 364/559 |
| 4,971,304 | 11/1990 | Lofthus | 271/227 |
| 5,078,384 | 1/1992 | Moore | 271/228 |
| 5,094,442 | 3/1992 | Kamprath et al. | 271/227 |
| 5,156,391 | 10/1992 | Roller | 271/227 |
| 5,169,140 | 12/1992 | Wenthe, Jr. | 271/228 |
| 5,273,274 | 12/1993 | Thomson et al. | 271/228 |
| 5,278,624 | 1/1994 | Kamprath et al. | 355/317 |
| 5,349,199 | 9/1994 | Rabjohns et al. | 250/561 |
| 5,676,477 | 10/1997 | Tanaka et al. | 400/579 |
| 5,678,159 | 10/1997 | Williams et al. | 399/395 |

*Primary Examiner*—Edgar Burr
*Assistant Examiner*—Dave A. Ghatt
*Attorney, Agent, or Firm*—Kevin R. Kepner

[57] ABSTRACT

A deskewing and registering device for an electrophotographic printing machine. A single sensor determines the position and skew of a sheet in a paper path and generate signals indicative thereof. A pair of independently driven nips forward the sheet to a registration position in skew and at the proper time based on signals from a controller which interprets the position signals and generates the motor control signals. An additional single sensor can be used at the registration position to provide feedback for updating the control signals as rolls wear or different substrates having different coefficients of friction are used.

10 Claims, 4 Drawing Sheets

APPARATUS AND METHOD FOR SHEET REGISTRATION USING A SINGLE SENSOR

This invention relates generally to a sheet registration system, and more particularly concerns an accurate, apparatus and method for registering sheets in a high speed printing machine using only a single sensor.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High quality documents require registration of sheets of paper or other substrate to the photoreceptor for image transfer. Accurate registration control locates the image consistently with respect to the edge of the paper. This invention describes a sheet registration apparatus and method which senses the position of a sheet at a first location and generates a set of control signals to cause the sheet to arrive at a second location in proper registry and skew.

The following disclosures may relate to various aspects of the present invention:

U.S. Pat. No. 4,438,917
Patentee: Janssen et al.
Issue Date: Mar. 27, 1984
U.S. Pat. No. 4,511,242
Patentee: Ashbee et al.
Issue Date: Apr. 16, 1985
U.S. Pat. No. 4,519,700
Patentee: Barker et al.
Issue Date: May 28, 1985
U.S. Pat. No. 4,971,304
Patentee: Lofthus
Issue Date: Nov. 20, 1990
U.S. Pat. No. 5,078,384
Patentee: Moore
Issue Date: Jan. 7, 1992
U.S. Pat. No. 5,094,442
Patentee: Kamprath et al.
Issue Date: Mar. 10, 1992
U.S. Pat. No. 5,156,391
Patentee: Roller
Issue Date: Oct. 20,1992
U.S. Pat. No. 5,169,140
Patentee: Wenthe, Jr.
Issue Date: Dec. 8, 1992
U.S. Pat. No. 5,273,274
Patentee: Thomson et al.
Issue Date: Dec. 28, 1993
U.S. Pat. No. 5,278,624
Patentee: Kamprath et al.
Issue Date: Jan. 11, 1994
U.S. Pat. No. 5,678, 159
Patentee: Williams et al.
Issue Date: Oct. 14, 1997

Some portions of the foregoing disclosures may be briefly summarized as follows:

4,438,917 describes a device for feeding sheets from a supply station aligning the sheets in an X, Y and theta coordinates and then gating the sheet into a work station. The device includes a pair of independently servo controlled motors disposed on opposite sides of the sheet. Each motor drives a nip roller which transports the copy sheet. Sensors are disposed to generate signals representative of sheet position in the X, Y and theta coordinates, which signals are used by the controller to adjust the angular velocity of the motor so that the sheet is squared and is gated onto the work station.

4,511,242 describes a device utilizing electronic alignment of paper feeding components in a machine such as an electrophotographic copier. Alignment is obtained by placing an original master containing vernier calibrations on the document class and a target master containing vernier calibrations in the copy paper bin. The machine is operated to produce a copy of the original master onto the target master producing a double set of vernier calibrations on the target master, which, when compared, provide information relating to skew angle, side edge relationship and leading edge alignment of the image to the copy paper. The vernier calibrations provide data which are read into a microprocessor controlled copy feeding servo mechanism to correct copy paper position and remove misalignment. This operation is repeated for various combinations of paper feed paths so that the copy paper matches image position for all modes of copier operation. Additionally, sensors are located in the paper path to automatically correct for deviations in the copy sheet feeding unit, caused by wear, for example, over a period of time.

4,519,700 describes a xerographic image transfer device in which copy sheets are sequentially aligned and position sensed before introduction to the image transfer zone. The position sensing is used to compare the copy sheet location with the position of the image panel on a moving photoconductor. The timing and velocity profile of the copy sheet drive after the position sensing is arranged so that the copy sheet arrives in registry with the image panel and at the some velocity.

4,971,304 describes a method and apparatus for an improved active sheet registration system which provides deskewing and registration of sheets along a paper path in X, Y and theta directions. Sheet drivers are independently controllable to selectively provide differential and non differential driving of the sheet in accordance with the position of the sheet as sensed by an array of at least three sensors. The sheet is driven non differentially until the initial random skew of the sheet is measured. The sheet is then driven differentially to correct the measured skew, and to induce a known skew. The sheet is then driven non differentially until a side edge is detected, whereupon the sheet is driven differentially to compensate for the known skew. Upon final deskewing, the sheet is driven non differentially outwardly from the deskewing and registration arrangement.

5,078,384 describes a method and apparatus for deskewing and registering a copy sheet, including the use of two or more selectably controllable drive rolls operating in conjunction with sheet skew and lead edge sensors, for frictionally driving and deskewing sheets having variable lengths. Subsequently, the sheets will be advanced so as to reach a predefined registration position at a predetermined velocity and time, at which point the sheets will no longer be frictionally engaged by the drive rolls.

5,094,442 describes a position registration device for sheets in a feed path achieved without using guides or gates.

Laterally separated drive rolls are speed controlled to correct for skew mis-positioning. Lateral registration is achieved by translation of the drive rolls transversely to the direction of sheet movement. Longitudinal registration is controlled by varying the speeds of the drive rollers equally.

5,156,391 describes an apparatus and method to deskew sheets in a short paper path in an electrophotographic printing machine by differentially driving two sets of rolls so as to create a paper buckle buffer zone in the sheet and then differentially driving a roll set to correct the skew while the sheet is still within the nips of multiple drive roll sets.

5,169,140 describes a method of deskewing and side registering a sheet which includes the step of driving a sheet non differentially in a process direction with a sheet driver, the sheet having an unknown magnitude of side to side registration and an unknown initial angle of skew. The method further includes the steps of measuring the initial skew angle with a sensing mechanism and driving the sheet differentially with the sheet driver to compensate for the magnitude of side to side misregistration and thereby induce a registration angle of skew. The method includes the steps of measuring the registration angle of skew with a sensing mechanism and summing the initial angle of skew and the registration angle of skew so as to determine an absolute angle of skew. The method includes driving the sheet differentially with the sheet driver to compensate for the absolute angle of skew so that the sheet is deskewed and one edge of the sheet is side registered.

5,273,274 describes a sheet feeding and lateral registration system including feed rollers for feeding sheets in a process direction and registration apparatus for registering each sheet in a direction laterally of the process direction. The registration apparatus includes a shifting system for laterally shifting a carriage on which the feed rollers are mounted. A single edge sensor is arranged to provide a signal on detecting the presence of a sheet, and a control controls the lateral shifting system in response to that signal. The control is operated such that if the sheet is not detected by the sensor on initial entry of the sheet into the feed rollers, then the shifting system is activated to move the feed rollers laterally towards the sensor until the sheet is detected by the sensor, whereupon the lateral movement is stopped. If the sheet is detected by the sensor on initial entry of the sheet into the system, then the shifting system is activated to move the feed rollers laterally away from the sensor until the sensor no longer detects the sheet, and then the shifting system is reverse activated to laterally move the feed rollers back towards the sensor until the sheet is again detected by the sensor.

5,278,624 describes a registration system for copy sheets using a pair of drive rolls and a drive system for commonly driving both drive rolls. a differential drive mechanism is provided for changing the relative angular position of one of the rolls with respect to the other roll to deskew the copy sheet. A control system is supplied with inputs representative of the skew of the copy sheet and controls the differential drive mechanism to deskew the copy sheet.

5,678,159 describes a deskewing and registering device for an electrophotographic printing machine. A single set of sensors determine the position and skew of a sheet in a paper path and generate signals indicative thereof. A pair of independently driven nips forward the sheet to a registration position in skew and at the proper time based on signals from a controller which interprets the position signals and generates the motor control signals. An additional set of sensors can be used at the registration position to provide feedback for updating the control signals as rolls wear or different substrates having different coefficients of friction are used.

In accordance with one aspect of the present invention there is provided an apparatus for registering and deskewing a sheet along a paper path, comprising a single sensor, located along an edge of the paper path, to sense a position of a sheet in the paper path and to generate a signal indicative thereof, a pair of independently driven drive nips located in the paper path for forwarding a sheet therealong and a controller, to receive signals from said single sensor and to generate motor control drive signals for said pair of independently driven drive nips so as to deskew and register a sheet at a registration position in the paper path.

Pursuant to another aspect of the present invention, there is provided an electrophotographic printing machine having a device for registering and deskewing a sheet along a paper path comprising a single sensor, located along an edge of the paper path, to sense a position of a sheet in the paper path and to generate a signal indicative thereof, a pair of independently driven drive nips located in the paper path for forwarding a sheet therealong and a controller, to receive signals from said single sensor and to generate motor control drive signals for said pair of independently driven drive nips so as to deskew and register a sheet at a registration position in the paper path.

Pursuant to yet another aspect of the present invention, there is provided a method for registering and deskewing a sheet along a paper path, comprising sensing the lead edge position and edge position of a sheet with a single sensor, determining a skew angle error and a registration position error of the sheet and generating signals indicative thereof and driving a pair of drive nips independently pursuant to a set of signals as a function of the skew angle error and registration position error so that the sheet arrives at a registration position at a proper time and in proper alignment position.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
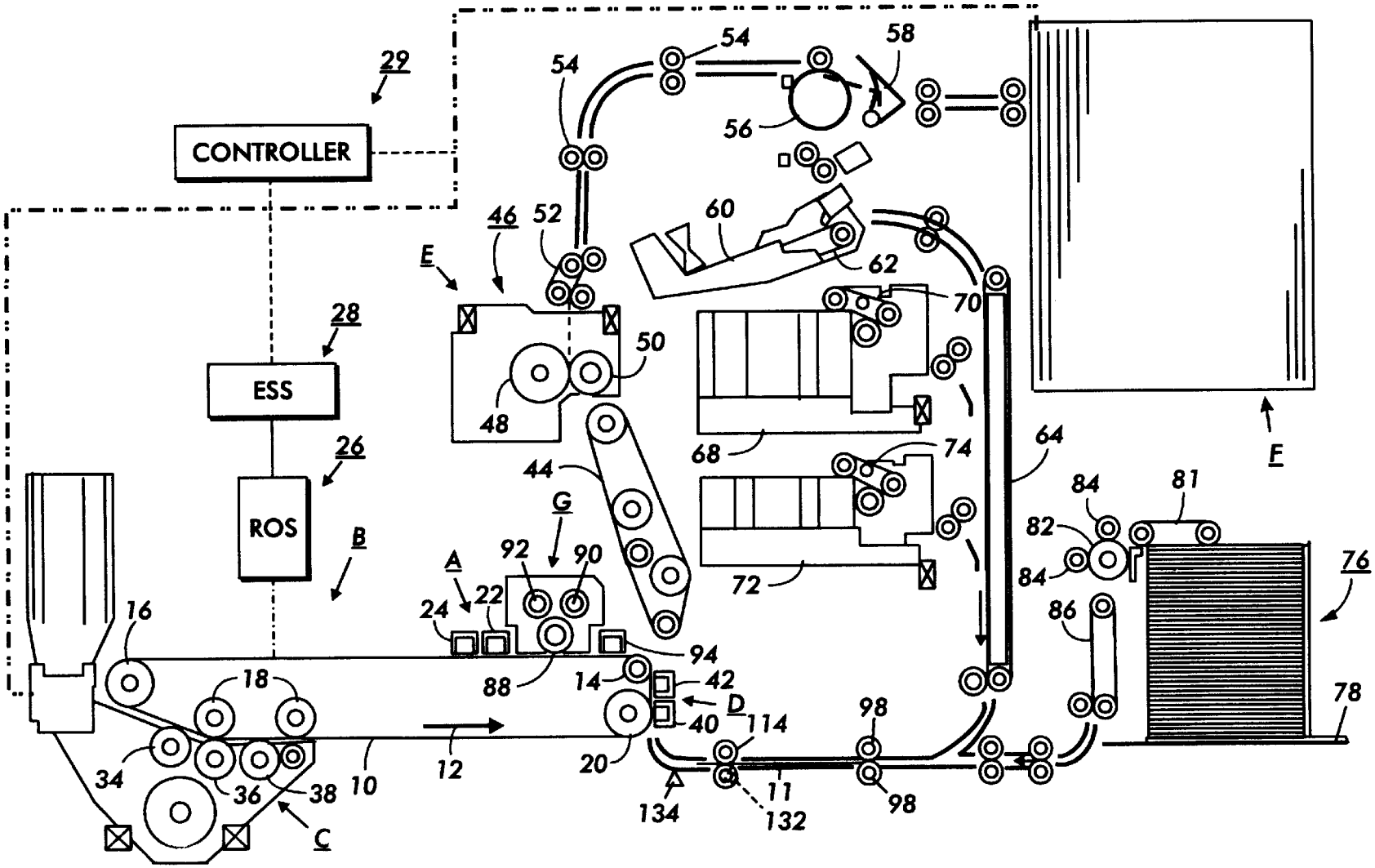
FIG. 1 is a schematic elevational view depicting an illustrative electrophotographic printing machine incorporating a sheet registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the set transfer device of the present invention may be employed in a wide variety of machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar®. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roll 18 and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22. Next, the charged portion of the photoconductive surface is advanced through imaging station B.

At imaging station B, a raster output scanner (ROS), indicated generally by the reference numeral 26, discharges selectively those portions of the charge corresponding to the image portions of the document to be reproduced. In this way, an electrostatic latent image is recorded on the photoconductive surface. An electronic subsystem (ESS), indicated generally by the reference numerals 28, controls ROS 26. E S S 28 is adapted to receive signals from a computer and transpose these signals into suitable signals for controlling ROS 26 so as to record an electrostatic latent image corresponding to the document to be reproduced by the printing machine. ROS 26 may include a laser with a rotating polygon mirror block. The ROS 26 illuminates the charged portion of the photoconductive surface. In this way, a raster electrostatic latent image is recorded on the photoconductive surface which corresponds to the desired information to be printed on the sheet. Other types of imaging systems may also be used employing, for example, a pivoting or shiftable LED write bar or projection LCD (liquid crystal display) or other electrooptic display as the "write" source.

Thereafter, belt 10 advances the electrostatic latent image recorded thereon to development station C. Development station C has three magnetic brush developer rolls indicated generally by the reference numerals 34, 36 and 38. A paddle wheel picks up developer material and delivers it to the developer rolls. When the developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a clean-up roll. A magnetic roll, positioned after developer roll 38, in the direction of arrow 12 is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl. Forwarding rollers 54 then advance the sheet to duplex turn roll 56. Duplex solenoid gate 58 guides the sheet to the finishing station F, or to duplex tray 60. At finishing station F, copy sheets are stacked in a compiler tray and attached to one another to form sets. The sheets can be attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposite side thereof, i.e., the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 98 which feed the sheets to the registration device of the invention herein, described in detail below, and then to transfer station D.

Copy sheets may also be fed to transfer station D from the auxiliary tray 72. The auxiliary tray 72 includes an elevator driven by a directional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 98 to the registration device and then to transfer station D.

Secondary tray 68 and auxiliary tray 72 are secondary sources of copy sheets. The high capacity sheet feeder, indicated generally by the reference numeral 76, is the primary source of copy sheets. Feed belt 81 feeds successive uppermost sheets from the stack to a take-away drive roll 82 and idler rolls 84. The drive roll and idler rolls guide the sheet onto transport 86. Transport 86 advances the sheet to rolls 98 which, in turn, move the sheet through the registration device to transfer station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller 29. The controller 29 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets. In addition, the controller regulates the various positions of the gates depending upon the mode of operation selected.

The invention herein has been illustrated in a high speed black and white printing machine. It is also very suitable for use in a high speed full color or highlight color printing machine where accurate sheet to image registration is critical.

High quality documents require registration of sheets of paper to the photoreceptor for image transfer. Accurate registration control locates the image consistently with respect to the edge of the paper.

Figure 2:
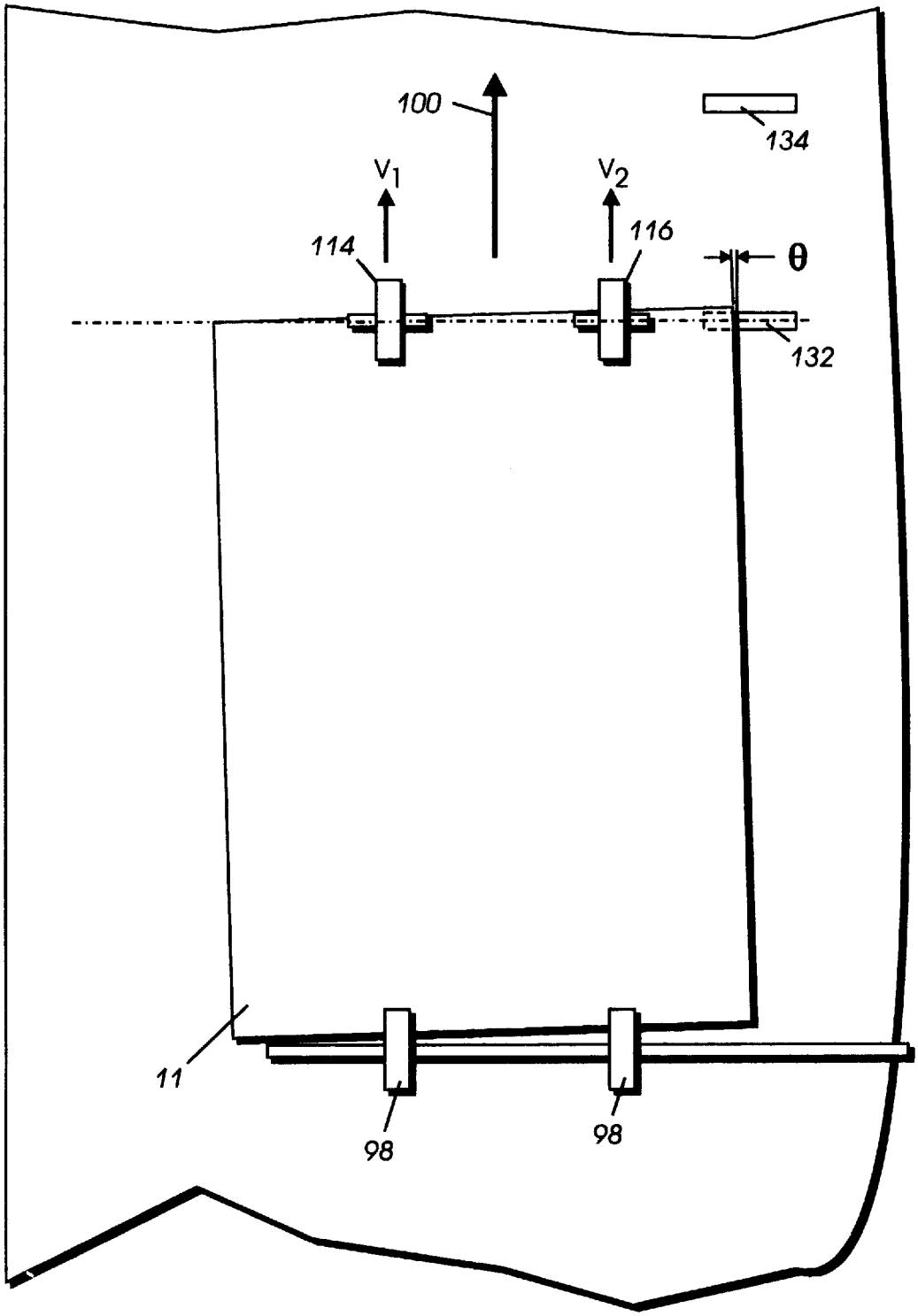
FIG. 2 is a detailed plan view of the sheet registration device described herein.
Figure 3:
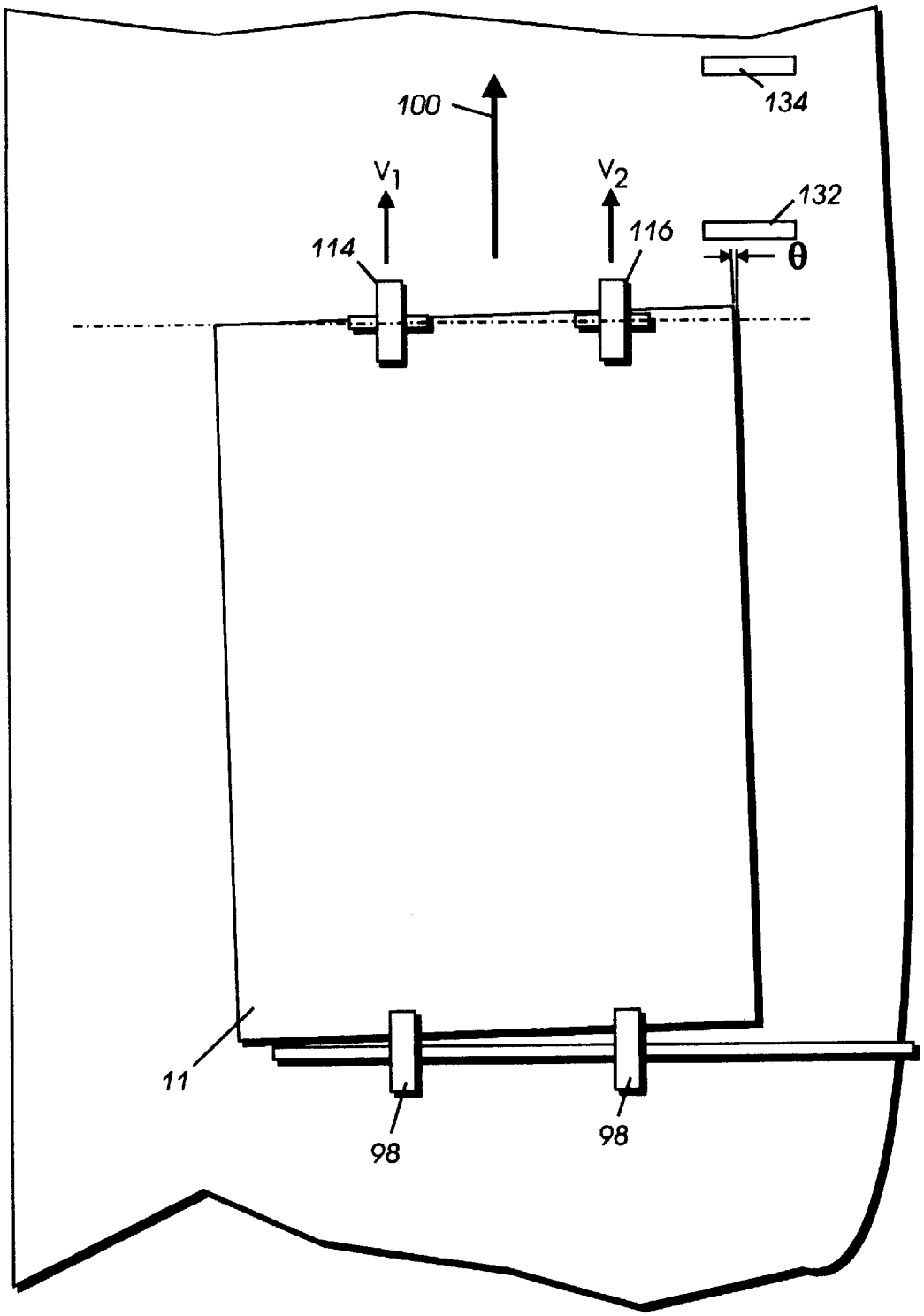
FIG. 3 is a detailed plan view of a second embodiment OF the sheet registration device described herein.

In the registration systems described by these documents, each copy sheet 11 is delivered from the paper tray to the registration mechanisms by standard conveyance means. The registration mechanisms consist of two separately programmed pinch rollers 114, 116 laterally disposed with respect to the process direction. The position of the pinch rollers should always remain in control of the sheets while the distance between rollers should be maximized for best performance. When the copy sheet 11 comes in control of the pinch rolls 114, 116, one of its forward corners comes in the range of a linear position sensor 132 positioned with its long axis substantially transverse to the process direction designated by arrow 100 so as to always be partially covered by one of the lateral edges of the sheet 11. Two possible arrangements are shown in FIG. 2 and FIG. 3. In the former, the sensor 132 is in line with the pinch rollers 114, 116 and in the latter the sensor 132 is not in line with the rollers 114,116.

Referring to FIGS. 2 and 3, when the forward right corner of the sheet 11 first comes over the sensor 132 partially covering it, the resulting signal suddenly changes. The time at which this occurs is in indication of the relative forward position of the sheet 11 with respect to its travel schedule. The magnitude of the sensor signal measures the lateral position of the forward right corner of the sheet. The last datum to describe the sheet state of registration is the angle Θ which it forms with a reference straight line such as the process direction or a line parallel thereto. This can be evaluated by the following:

a. since the independently controlled pinch wheel speeds $V_1$ and $V_2$ are known at all times, the forward and lateral components of velocity, $V_f$ and $V_l$ respectively, of the sheet at the sensor can be calculated;

b. the skew angle Θ of the sheet lateral side is computed as a ratio where:

1. the numerator is the difference between the rate of change of the sensor signal and the lateral velocity component of the sheet over the sensor.
   2. the denominator is the forward velocity component of the sheet at the sensor.

Figure 4:
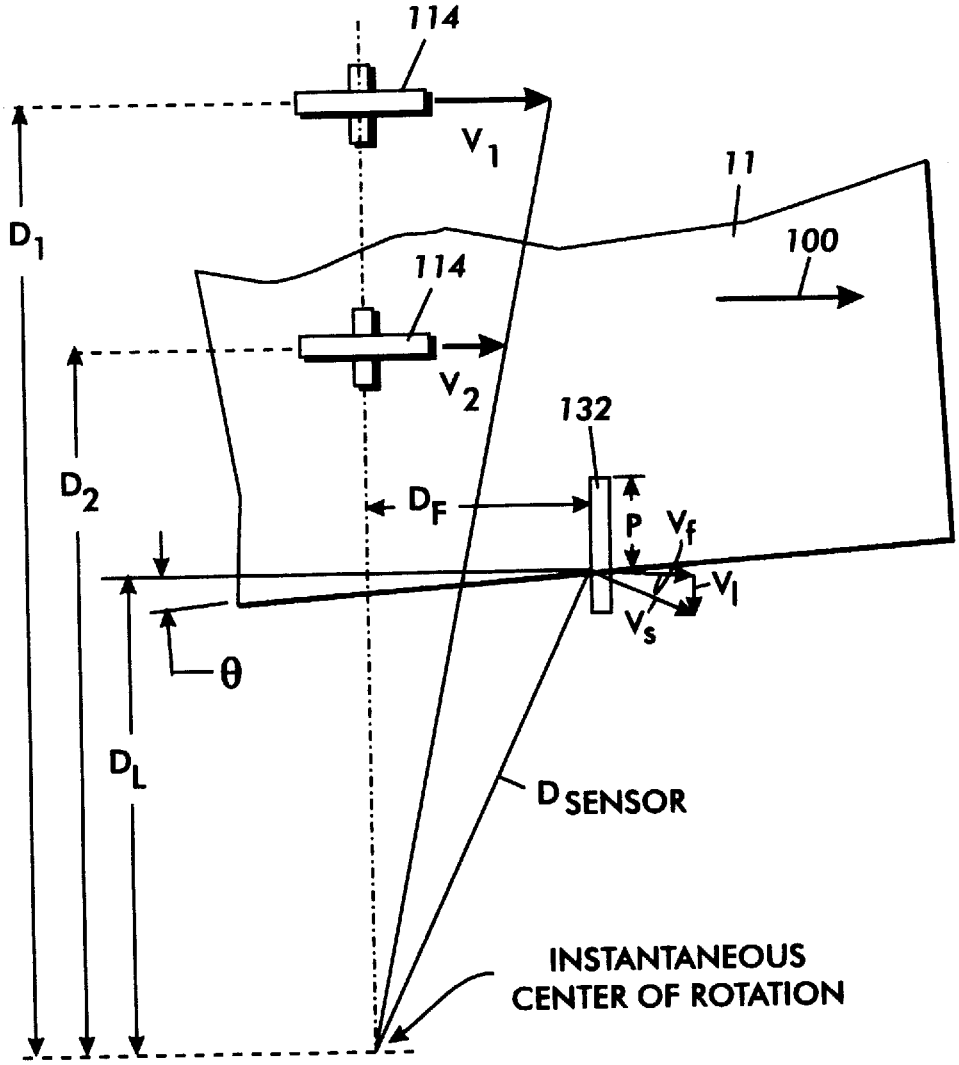
FIG. 4 is a detailed plan view illustrating the operation of the first embodiment of the sheet registration device described herein.

These are represented by the equations:

$$V_s = D_s * V_1 / D_1$$

$$V_f = D_l * V_1 / D_1$$

$$V_f = D_f * V_1 / D_1$$

$$\Theta = [(dP/dt) - V_l] / V_f$$

Where as shown in FIG. 4, $V_s$ is the velocity at the sensor; $D_1$ is the lateral distance from the drive nip to the center of instantaneous rotation of the sheet; $D_2$ is the lateral distance from the second drive nip to the center of instantaneous rotation of the sheet; $D_l$ is the lateral distance from the sensed position on the sensor to the center of instantaneous rotation of the sheet; $D_f$ is the process direction distance from the contact point of the drive nips to the sensor; and $D_s$ is the resultant distance from the sensed point to the center of instantaneous rotation of the sheet.

FIG. 4 graphically indicates the concept of skew determination where P is the desired registration position at the sensor. In performing the above-indicated calculation, the configuration of FIG. 2 offers the simplification of having a lateral velocity $V_l$ component of the sheet equal zero.

This methodology allows complete knowledge of the state of sheet registration at the initial time of control and a continuous knowledge of the skew angle throughout the registration action. Proper motion for the wheels can then be synthesized to achieve the desired outlet registration which usually consists of:

a. the coordinates of the forward right corner of the sheet must achieve a given value at a given time;

b. the speed of the forward right corner must be of a given value;

c. the skew angle of the sheet must be equal to zero.

An additional single sensor 134 (FIGS. 2 and 3) can be used at a downstream position to provide feedback for updating the control signals as rolls wear or different substrates having different coefficients of friction are used.

In recapitulation, there is provided a deskewing and registering device for an electrophotographic printing machine. A single single sensor determine the position and skew of a sheet in a paper path and generate signals indicative thereof. A pair of independently driven nips forward the sheet to a registration position in skew and at the proper time based on signals from a controller which interprets the position signals and generates the motor control signals. An additional single sensor can be used at the registration position to provide feedback for updating the control signals as rolls wear or different substrates having different coefficients of friction are used.

It is, therefore, apparent that there has been provided in accordance with the present invention, a sheet registration and deskewing device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for registering and deskewing a sheet along a paper path, comprising:

a single sensor only located along the paper path, to sense a position of a sheet in the paper path and to generate a signal indicative thereof;

a pair of independently driven drive nips located in the paper path for forwarding a sheet therealong;

a controller, to receive signals from said single sensor and to generate motor control drive signals for said pair of independently driven drive nips as a function of said signals so as to deskew and register a sheet at a registration position in the paper path downstream in the path from said single sensor.

2. An apparatus according to claim 1, wherein said single sensor comprises:

a first edge sensor located along a peripheral edge of the paper path, to sense both the arrival of a lead edge of a sheet and the lateral edge position of a sheet.

3. An apparatus according to claim 1, further comprising a second single sensor located at a position downstream of said first single sensor at the registration position to sense the position of the sheet and to generate signals indicative thereof.

4. An apparatus according to claim 3, wherein the signals from said second single sensor are used to update said controller so that sheets are properly deskewed and registered.

5. An electrophotographic printing machine having a device for registering and deskewing a sheet along a paper path comprising:

a single sensor only located along the paper path, to sense a position of a sheet in the paper path and to generate a signal indicative thereof;

a pair of independently driven drive nips located in the paper path for forwarding a sheet therealong;

a controller, to receive signals from said single sensor and to generate motor control drive signals for said pair of independently driven drive nips as a function of said signals so as to deskew and register a sheet at a registration position in the paper path.

6. A printing machine according to claim 5, wherein said single sensor comprises:

a first edge sensor located along a peripheral edge of the paper path, to sense both the arrival of a lead edge of a sheet and the lateral edge position of a sheet.

7. A printing machine according to claim 5, further comprising a second single sensor located at a position downstream of said first single sensor at the registration position to sense the position of the sheet and to generate signals indicative thereof.

8. A printing machine according to claim 7, wherein the signals from said second single sensor are used to update said controller so that sheets are properly deskewed and registered.

9. A method for registering and deskewing a sheet along a paper path, comprising:

sensing the lead edge position and edge position of a sheet with a single sensor only to sense a position of a sheet in the paper path and to generate a signal indicative thereof;

determining a skew angle error and a registration position error of the sheet and generating a set of signals indicative thereof;

driving a pair of drive nips independently pursuant to said set of signals as a function of the skew angle error and registration position error so that the sheet arrives at a registration position downstream in the paper path from the single sensor at a proper time and in proper alignment position.

10. A method according to claim 9, further comprising checking a position of the sheet at the registration position with a second single sensor and sending the position information to a controller to update a drive control function.

* * * * *